US010743725B2

(12) United States Patent
Scheimberg

(10) Patent No.: US 10,743,725 B2
(45) Date of Patent: Aug. 18, 2020

(54) RETRACTABLE TOILET PAPER HOLDER

(71) Applicant: Ruben Scheimberg, Valencia, CA (US)

(72) Inventor: Ruben Scheimberg, Valencia, CA (US)

(73) Assignee: Ruben Scheimberg, Valencia, CA (US)

( * ) Notice: Subject to any disclaimer, the term of this patent is extended or adjusted under 35 U.S.C. 154(b) by 258 days.

(21) Appl. No.: 15/917,094

(22) Filed: Mar. 9, 2018

(65) Prior Publication Data

US 2019/0274493 A1 Sep. 12, 2019

(51) Int. Cl.
*A47K 10/40* (2006.01)
*A47K 10/22* (2006.01)

(52) U.S. Cl.
CPC ..... *A47K 10/40* (2013.01); *A47K 10/22* (2013.01); *A47K 2201/02* (2013.01)

(58) Field of Classification Search
CPC ..... A47K 10/40; A47K 10/22; A47K 2201/02
USPC ..... 242/591, 592
See application file for complete search history.

(56) References Cited

U.S. PATENT DOCUMENTS 4,741,486 A * 5/1988 Ancona ..... A47K 10/3836 242/597.4
5,868,345 A * 2/1999 Beisser ..... A47K 10/38 242/592
5,871,170 A * 2/1999 Morales ..... A47K 10/40 242/592
5,967,452 A * 10/1999 Wilder ..... A47K 10/3836 242/592
6,527,219 B1 * 3/2003 Trecartin ..... A47K 10/38 242/592
7,306,185 B1 * 12/2007 Miller ..... A47K 10/3836 242/592
2005/0029392 A1 * 2/2005 Guay ..... A47K 10/38 242/597

* cited by examiner

*Primary Examiner* — William A. Rivera
(74) *Attorney, Agent, or Firm* — Keith Miller

(57) ABSTRACT

A toilet paper holder comprising a base, an extendable arm having a first end and a distal end with the first end rotatably coupled to the base, and a toilet roll mount connected to the distal end of the arm. The extendable arm having alternative variations, one variation having a plurality of interlocking arms and a second variation being an expandable telescopic arrangement having a plurality of segments.

20 Claims, 4 Drawing Sheets

RETRACTABLE TOILET PAPER HOLDER

DETAILED DESCRIPTION OF THE INVENTION

The following description of the preferred embodiments of the invention is intended to enable one skilled in the prior art to make and use this invention, but is not intended to limit the invention to these preferred embodiments.

Figure 1:
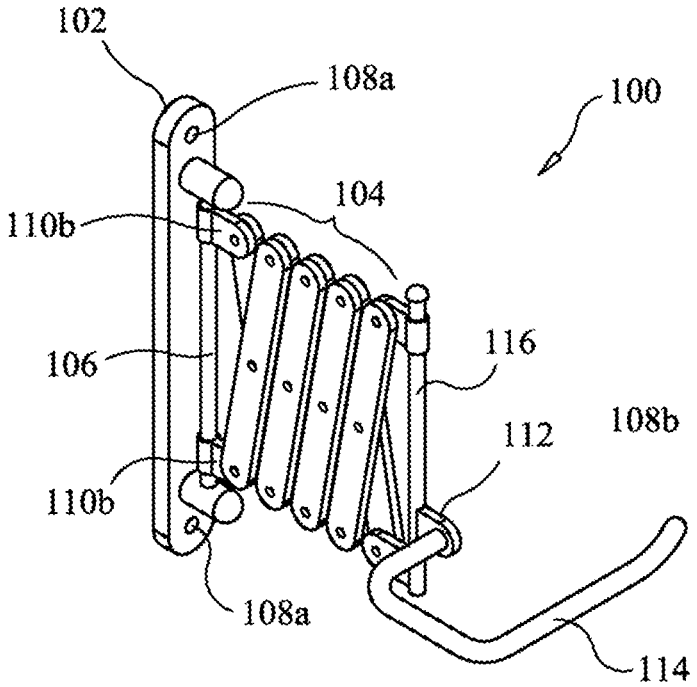
FIG. 1 is a perspective view of a retractable toilet paper holder in a collapsed configuration according to an embodiment of the present invention.

Now referring to FIG. 1A, the invention described herein is a retractable toilet paper holder 100 comprising a wall mount means 102 to which an extendable expansion arm 104 is attached via a swivel arm 106. The swivel arm 106 allows the extendable expansion arm to be rotated axially through a range of approximately zero (0) degrees to approximately one-hundred twenty (120) degrees relative to the wall mount means 102. The wall mount means 102 includes two or more sockets for receiving screws for the mounting of the wall mount means 102 onto a vertical wall and at least two post mounts 108*a*, 108*b* for receiving and securing the swivel arm 106.

The extendable expansion arm 104 is preferably rotatably coupled to the swivel arm 106 using at least two connectors 110*a* and 110*b*, each connector having sufficient connection strength for establishing a rotatable connection between the extendable expansion arm 104 and the swivel arm 106. In one embodiment, the extendable expansion arm 104 is comprised of a plurality of expansion elements in a scissor-like arrangement that can be collapsed and expanded over a horizontal range of from three (3) inches to twenty (20) inches wherein each element in the expansion arm 104 has a length of at least five (5) inches, and preferably 5.625 inches, and wherein each element is coupled in successive fashion using at least three fused metal connections that enable ease of expansion and contraction of the extendable expansion arm 104. In alternative embodiments, the extendable expansion arm 104 is comprised of a plurality of elements in a telescoping arrangement in which element slides outward when extending the extendable expansion arm 104 or inward when collapsing the extendable expansion 104.

The extendable expansion arm 104 further includes a terminal post 116 at its distal end on which a holder mounting means 112 for a toilet roll holder 114 is placed. Preferably, the holder mounting means 112 is a metallic extension extending from the terminal post 116 onto which the toilet roll holder 114 is fused. Alternatively, a holder mounting means 112 is a clasp or other similar means for securely snapping or attaching the toilet roll holder 114 onto the terminal post 116 of the extendable expansion arm 104. In an embodiment, the toilet roll holder 114 is comprised of stainless steel and arranged to receive and permit ease of installation and use of a roll of toilet paper. In the illustrated embodiment, the toilet roll holder 114 is formed into a semi-rectangular structure having an inner side-to-side spatial separation of 2.5 inches. The shape and spatial arrangement of the holder 114 is not to be limited to such structure, shape or dimension and alternative structural shapes can be used to enable quick and convenient installation, replacement and use of a toilet paper roll on an extendable expansion arm 104.

Figure 2A:
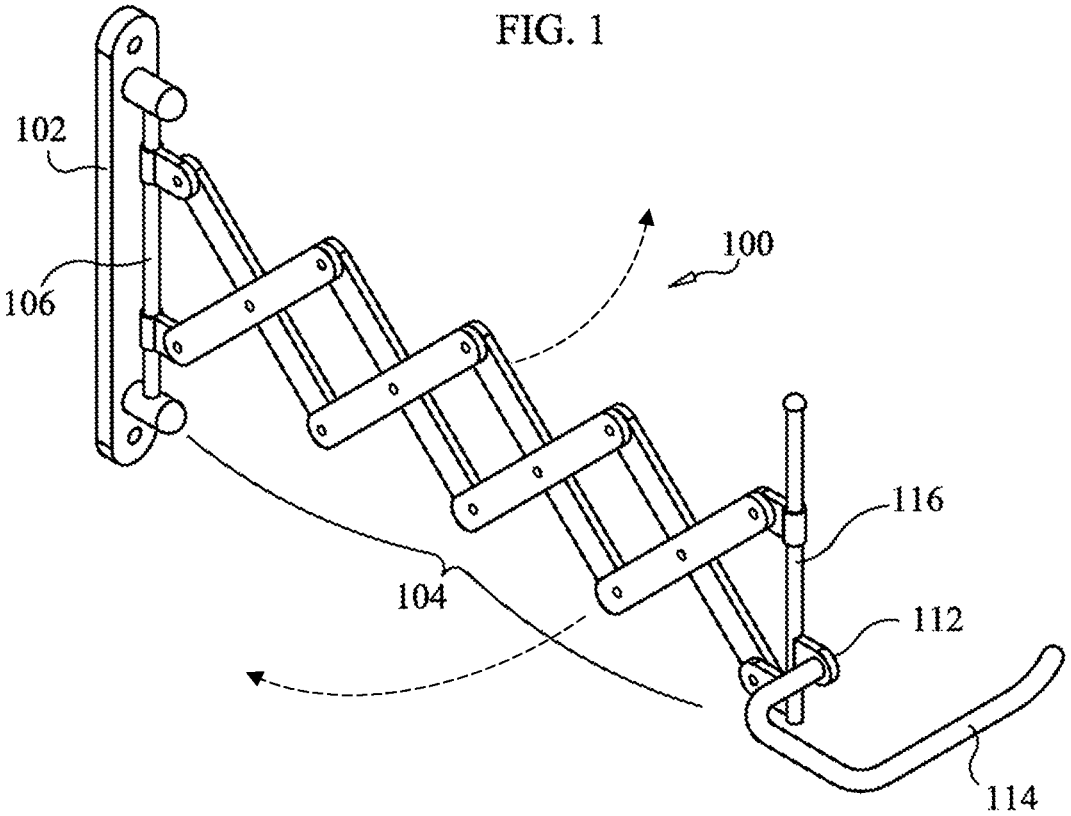
FIG. 2A is a perspective view of a retractable toilet paper holder in an expanded configuration according to an embodiment of the present invention.
Figure 2B:
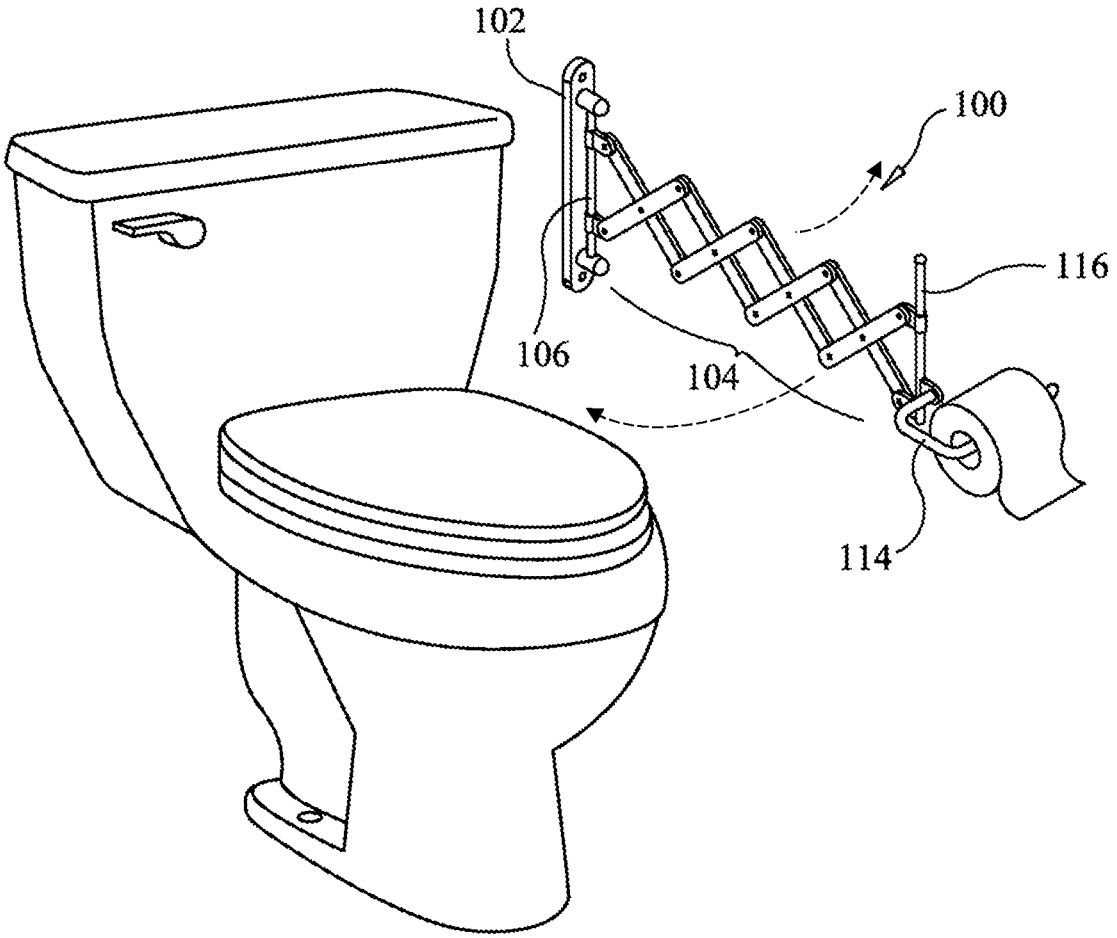
FIG. 2B is a perspective view of a retractable toilet paper holder in an expanded configuration in proximity to a toilet according to an embodiment of the present invention.

FIG. 2A is an illustration of the extendable expansion arm 104 in an expanded configuration extending vertically from a side wall. Preferably, the wall mount means 102, swivel arm 106, extendable expansion arm 104, the toilet roll holder 114 and the holder mounting means 112 are formed from stainless steel. However, other suitable materials can also be used with material strength that is comparable to that provide by steel such as various metallic composite materials or durable plastic compounds. Although the vertical length of the assembly comprising the swivel arm 106, the extendable expansion arm 104 and the terminal post 116 is seven (7) inches in the illustrated embodiment, the lengths of these elements can vary depending on the spatial limitations of each location and the function of this apparatus is not to be limited strictly to such dimensions. FIG. 2B depicts the expanded configuration of the retractable toilet paper holder 100 placed adjacent to a toilet with a roll of toilet paper placed on a toilet roll holder 114 connected to the expanded expansion arm 104.

Figure 3:
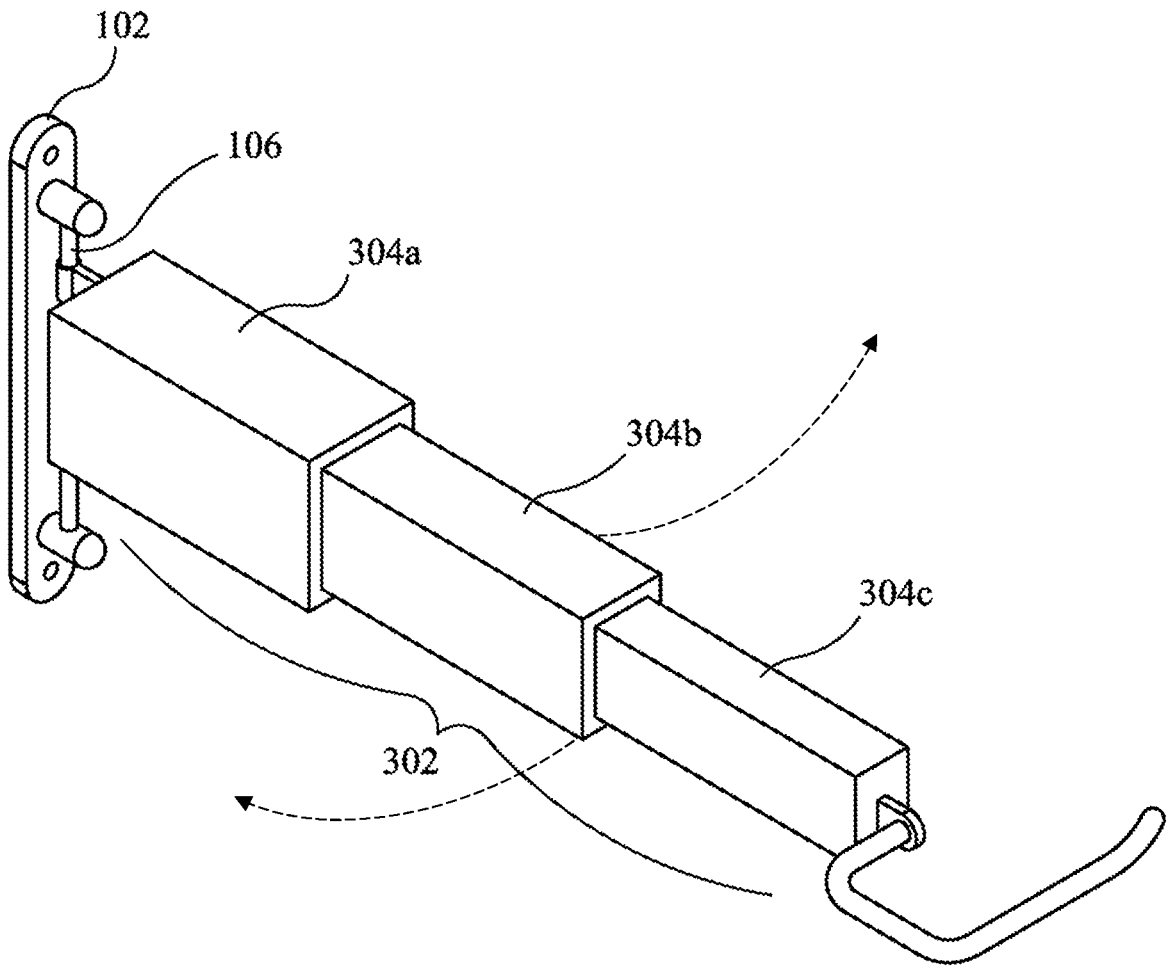
FIG. 3 is a perspective view of a retractable toilet paper holder using an extendable telescopic arm according to an embodiment of the present invention.

FIG. 3 illustrates an embodiment of the retractable toilet paper holder having an extendable telescopic expansion arm 302 comprised of a plurality of interconnected elements 304*a*, 304*b*, 304*c* for expanding and collapsing the expansion arm 302. The plurality of interconnected elements 304*a*, 304*b*, 304*c* comprising the telescopic expansion arm 302 are made from metal and include a plurality of grooves and securing bolts in a housing to enable the arrangement to be attached to the swivel arm 106 and supported by a wall mount means 102 for rotatable access by a user. In alternative embodiments the interconnecting elements are formed from plastic or other durable polymer compounds suitable for use near water and the variable temperature conditions in most commercial restrooms and household bathrooms. The telescopic arrangement in the illustrated embodiment expands over a horizontal range of from three (3) inches to twenty (20) inches and can be axially rotated over a range of approximately zero (0) degrees to one-hundred twenty (120) degrees.

Figure 4:
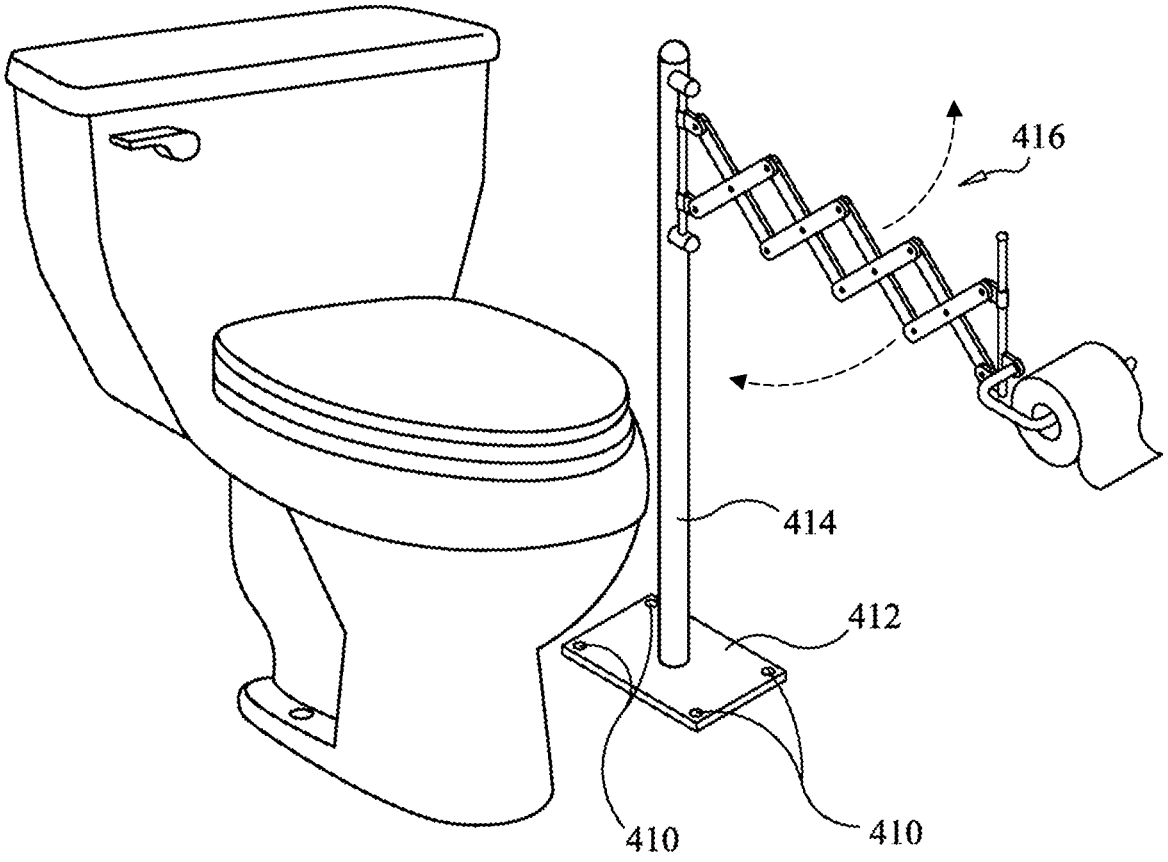
FIG. 4 is a perspective view of a retractable toilet paper holder using a floor mount means according to an embodiment of the present invention.

FIG. 4 illustrates an embodiment of a retractable toilet paper holder coupled to a floor mount means 410. In the illustrated embodiment, the floor mount means 410 is comprised of a plurality of sockets for receiving screws that secure the floor mount means 410 to a spatial location on the floor adjacent to a toilet and a base plate 412 for receiving a rotatable swivel arm 414 onto which an extendable expansion arm 416 is coupled. In alternative embodiments, the floor mount means 410 can be secured to a location on the floor using a durable polymer bond or other suitable base mounting mechanism. The expansion arm can be extended or collapsed by a user and rotated in a circular manner three-hundred sixty (360) degrees about the central swivel arm 414. In a preferred embodiment, the extendable expansion arm 416 is comprised of a plurality of metallic elements in a scissor-like arrangement as described previously with respect to the embodiments illustrated in FIGS. 1, 2A and 2B. A roll holder mount means 418 is provided on a terminal post 420 for securely receiving and holding a toilet roll holder 422. The lengths, heights and material composition of this embodiment of the retractable toilet roll holder are comparable to those described and illustrated in FIGS. 1, 2A and 2B.

Although specific embodiments have been illustrated and described herein, it will be appreciated by those of ordinary skill in the art that a wide variety of alternate and/or equivalent implementations may be substituted for the specific embodiments shown and described without departing from the scope of the present invention. This application is intended to cover any adaptations or variations of the embodiments discussed herein.

What I claim is:

1. A toilet paper holder comprising:

a base;

an extendable arm having a first end and a distal end, wherein the first end is rotatably coupled to the base and the distal end comprises a post; and a toilet roll mount connected to the distal end of the extendable arm, wherein the toilet roll mount comprises a rigid semi-rectangular structure including a first side coupled to the post and disposed closest to the base, a second side parallel the first side and disposed farthest from the base, and a third side connecting the first side and the second side, and wherein the toilet roll mount is configured such that a roll of toilet paper can be mounted on and rotated around the second side.

2. The toilet paper holder of claim 1 wherein the base is configured to attach to at least one of a wall surface and a floor surface.

3. The toilet paper holder of claim 2 wherein the base is configured to attach to the floor surface, and wherein the expansion arm is rotatably coupled to the base using a swivel arm configured to allow the expansion arm to rotate around the swivel arm up to three hundred and sixty (360) degrees.

4. The toilet paper holder of claim 1 wherein the extendable arm is an extendable suspension arm comprised of a plurality of interlocking expansion elements.

5. The toilet paper holder of claim 4 wherein the extendable arm is an extendable telescopic arm comprised of a plurality of interconnected segments.

6. The toilet paper holder of claim 5 wherein the extendable arm is configured to extend horizontally over a range of from approximately three (3) inches to approximately twenty (20) inches.

7. The toilet paper holder of claim 5 wherein the plurality of interconnected elements is comprised of metal and further include a plurality of grooves and securing bolts in a housing to enable the arrangement to be rotatably coupled to the base using a swivel arm.

8. The toilet paper holder of claim 4 wherein the plurality of interlocking expansion elements is configured to expand and collapse in a scissor-like arrangement.

9. The toilet paper holder of claim 8 wherein an each of the plurality of interlocking expansion elements has a length of at least five (5) inches.

10. The toilet paper holder of claim 9 wherein the each of the plurality of interlocking expansion elements has a length of 5.625 inches.

11. The toilet paper holder of claim 8 wherein the extendable arm is configured to extend horizontally over a range of from approximately three (3) inches to approximately twenty (20) inches.

12. The toilet paper holder of claim 1 wherein the extendable arm is rotatably coupled to the base using a swivel arm.

13. The toilet paper holder of claim 12 wherein the extendable arm is configured to be axially rotatable around the swivel arm.

14. The toilet paper holder of claim 13 wherein the extendable arm is configured to rotate axially over a range of from approximately zero (0) degrees to approximately one-hundred twenty (120) degrees relative to the base.

15. The toilet paper holder of claim 1 wherein the rigid semi-rectangular structure comprises a metallic material.

16. The toilet paper holder of claim 15 wherein the toilet roll mount is comprised of stainless steel.

17. The toilet paper holder of claim 1 wherein the toilet roll mount is coupled to the post on the distal end of the extendable arm using a metallic clasp.

18. The toilet paper holder of claim 1 wherein the first side of the toilet roll mount is separated from the second side at a distance of approximately 2.5 inches.

19. A toilet paper holder comprising:

a base including a swivel arm;

an extendable arm having a first end and a distal end, wherein the first end is rotatably coupled to the base and the distal end comprises a post; and a toilet roll mount connected to the distal end of the extendable arm, wherein the toilet roll mount comprises a rigid semi-rectangular structure including a first side coupled to the post and disposed closest to the base, a second side parallel the first side and disposed farthest from the base, and a third side connecting the first side and the second side, and wherein the toilet roll mount is configured such that a roll of toilet paper can be mounted on and rotated around the second side, and wherein the extendable arm is one of an extendable telescopic arm and an extendable suspension arm comprised of a plurality of interlocking expansion elements configured to expand and collapse in a scissor-like arrangement.

20. The toilet paper holder of claim 19 wherein the extendable arm is configured to rotate axially over a range of from approximately zero (0) degrees to approximately one-hundred twenty (120) degrees relative to the base.

* * * * *